United States Patent [19]

Gregory

[11] Patent Number: 4,778,144

[45] Date of Patent: Oct. 18, 1988

[54] CONCRETE SLAB AND BEAM FORMING SYSTEM

[76] Inventor: R. Kirk Gregory, 1110 Eikel, Suite E., New Braunfels, Tex. 78130

[21] Appl. No.: 6,137

[22] Filed: Jan. 23, 1987

[51] Int. Cl.[4] ..... E04G 11/46

[52] U.S. Cl. ..... 249/29; 249/50; 249/171; 249/192; 264/33; 425/63

[58] Field of Search ..... 249/13, 18, 26, 28, 249/29, 50, 189, 192, 193–196, 219 R, 170–172, 185; 425/62, 63; 264/33, 34

[56] References Cited

U.S. PATENT DOCUMENTS

| | | | |
|---|---|---|---|
| 2,738,563 | 3/1956 | Steele | 249/195 |
| 3,148,434 | 9/1964 | Gage et al. | 249/185 |
| 3,234,620 | 2/1966 | Short | 425/62 |
| 4,470,574 | 9/1984 | Jackson | 249/29 |
| 4,520,990 | 6/1985 | Maier | 249/170 |
| 4,585,204 | 4/1986 | Parker et al. | 249/28 |

*Primary Examiner*—Jay H. Woo
*Assistant Examiner*—James C. Housel
*Attorney, Agent, or Firm*—Cox & Smith

[57] ABSTRACT

A concrete slab and beam forming system including first and second shoring towers that are adjustable in height and which can be adjusted to provide for concrete beams of different depths. The forming system also includes a first plank with an integral facing, and second and third planks having integral facings which are pivotally attached at opposite ends of the first plank and which rest upon adjacent shoring towers in a first position in which the facings of all the planks are substantially coplanar. The planks are provided with bolts for releasably securing the second and third planks in that first position and operable to allow the second and third planks to be pivoted to a second position in which the facings of the second and third planks are substantially perpendicular to the facing of the first plank. One component of the slab and beam forming system is the slab form, another component is the shoring tower, and a method is provided for constructing a concrete slab supported by a beam using the components of the forming system.

14 Claims, 7 Drawing Sheets

CONCRETE SLAB AND BEAM FORMING SYSTEM

BACKGROUND OF THE INVENTION

The present invention relates to a system for forming concrete slabs and beams. More particularly, the present invention relates to a concrete forming system having a slab form and shoring towers, wherein the slab form can be removed from a cured slab while the shoring towers remain in place to permit complete curing of the beams.

Modern post-tensioned concrete parking garages are constructed with very deep beams which require very strong shoring because both the weight of the slab and the weight of the beam itself are gathered to the beam shore when the slab tendons are pulled. Traditionally, the slab soffit is constructed between 9 and 10 feet in height and the deep beams are constructed to provide around 6½ to 7½ feet of clearance for movement of forming and shoring equipment.

Traditionally, post-tensioned concrete parking garages have been built using slab forms, shoring frames and beam forms of lumber and plywood which are taken apart as the forms are stripped from the concrete, stacked on dollies, and towed up the ramps to be reused in forming the next level of slabs and beams. The nailing, stripping, renailing, and handling of the wood damages the wood, and is both labor intensive and time consuming.

Aluminum beams having 2×2 nailers have also been used in the construction of post-tensioned concrete parking garages, but the aluminum beams suffer the disadvantage that they also must be handled individually several times in stripping and resetting.

Another system for construction of post-tensioned concrete parking garages uses a steel beam form with steel tubular shoring towers having legs which fold flat so that the shoring tower can be lowered with a fork lift onto dollies and then towed beneath existing shoring and beams to another level for further use. The steel beam form method requires that the beam forms on one level be stripped and moved before any of the slab or other beam forms can be transported to another location for re-use. That method is also labor intensive and time consuming.

Accordingly, a need has arisen for a faster and more efficient way of constructing poured in place, multilevel parking garages without the use of cranes.

It is, therefore, an object of the present invention to provide a concrete slab and beam forming system which can be used quickly and easily, without the necessity of disassembling and re-assembly.

Another object of the present invention is to provide a concrete slab form which can be released from a poured concrete slab after the concrete has cured which is provided with folding edge wings on each side capable of becoming the legs of the slab form when folded down.

A further object of the present invention is to provide a self-contained, stable slab form having casters on the ends of pivotally attached planks so that the form can be moved between and under existing shoring towers and beam forms to another location for reuse.

It is yet another object of the present invention to provide a system for construction of concrete slabs and beams which permits the pouring of large sections of slab and beam all at one time.

Yet another object of the present invention is to provide a slab deck form which can be stripped and reused during the additional period of time required for the concrete in the beam forms to cure even though both forms were poured at the same time.

A further object of the present invention is to provide a concrete slab and beam forming system which is inexpensive and light in weight.

Another object of the present invention is to provide a concrete slab form and beam form system wherein sufficient clearance is provided for moving equipment beneath beam forms and between shoring tower legs.

A further object of the present invention is to provide a concrete slab and beam forming system in which continuity of long spans of beam forms and shoring towers can be achieved.

Another object of the present invention is to provide a rollable slab form which does not require separate dollies for moving and which can be transported to a new location ready to be installed in place for pouring of concrete.

Yet another object of the present invention is to provide a concrete slab and beam forming system having a shoring tower and beam form which is capable of retracting from about 9½ feet to about 5 feet in height, thereby being capable of supporting a slab or deck at any of the heights likely to be required for construction of most poured in place concrete structures.

A further object of the present invention is to provide a concrete slab and beam forming system which can be constructed of wood, thereby reducing the costs and construction time required for constructing post tensioned concrete parking garages and other similar buildings.

Yet another object of the present invention is to provide a concrete slab and beam forming system which is safer to use than those currently available because the slab form is a more stable unit and the beam form weighs less and has stable 4 leg towers when being moved.

These and other objects of the present invention will become evident to those skilled in the art who have the benefit of the description of the preferred embodiment which follows.

SUMMARY OF THE INVENTION

These objects are accomplished by providing first and second shoring towers, each of the shoring towers comprising a first leg, a second leg substantially parallel to the first leg, a first guide bar integral with the first leg and having a plurality of holes spaced along the length thereof, a second guide bar integral with the second leg and having a plurality of holes spaced along the length thereof, a ledger selectively positionable in the holes spaced along the first and second guide bars, and means mounted to the ledger for forming a concrete beam. The concrete slab and beam forming system is also provided with a first plank having a facing integral therewith, a third plank having a facing integral therewith, the second and third planks being pivotally attached at one end of the second and third planks to opposite ends of the first plank and supported at the other end by the first leg of the first shoring tower and the first leg of the second shoring tower in a first position in which the facings of the first, second, and third planks are substantially coplanar. The concrete slab and beam forming system is further provided with means for releasably securing the second and third planks in the first position, and means for securing the second and third planks in a second position in which the facing of the second and third planks is substantially perpendicular to the facing of the first plank.

A method for constructing a concrete slab supported by a beam is also provided which comprises erecting first and second shoring towers having integral beam forms mounted thereto on a surface, releasably supporting the ends of the planks of a slab form between the first and second shoring towers, pouring concrete into the slab form and the beam forms, allowing the concrete in the slab form and beam form to core, releasing the ends of the planks of the slab form from the first and second shoring towers, and pivoting the ends of the planks of the slab form away from the poured slab. After a slab is poured and cured sufficiently, the slab form can be lowered away from the beam forms before the concrete in the beam form is set, after the ends of the planks of the slab form have been folded downwards. In its folded form, the slab form can be moved beneath the beam forms and between the shoring towers to be reused at another location.

DETAILED DESCRIPTION OF THE PREFERRED EMBODIMENT

Figure 4:
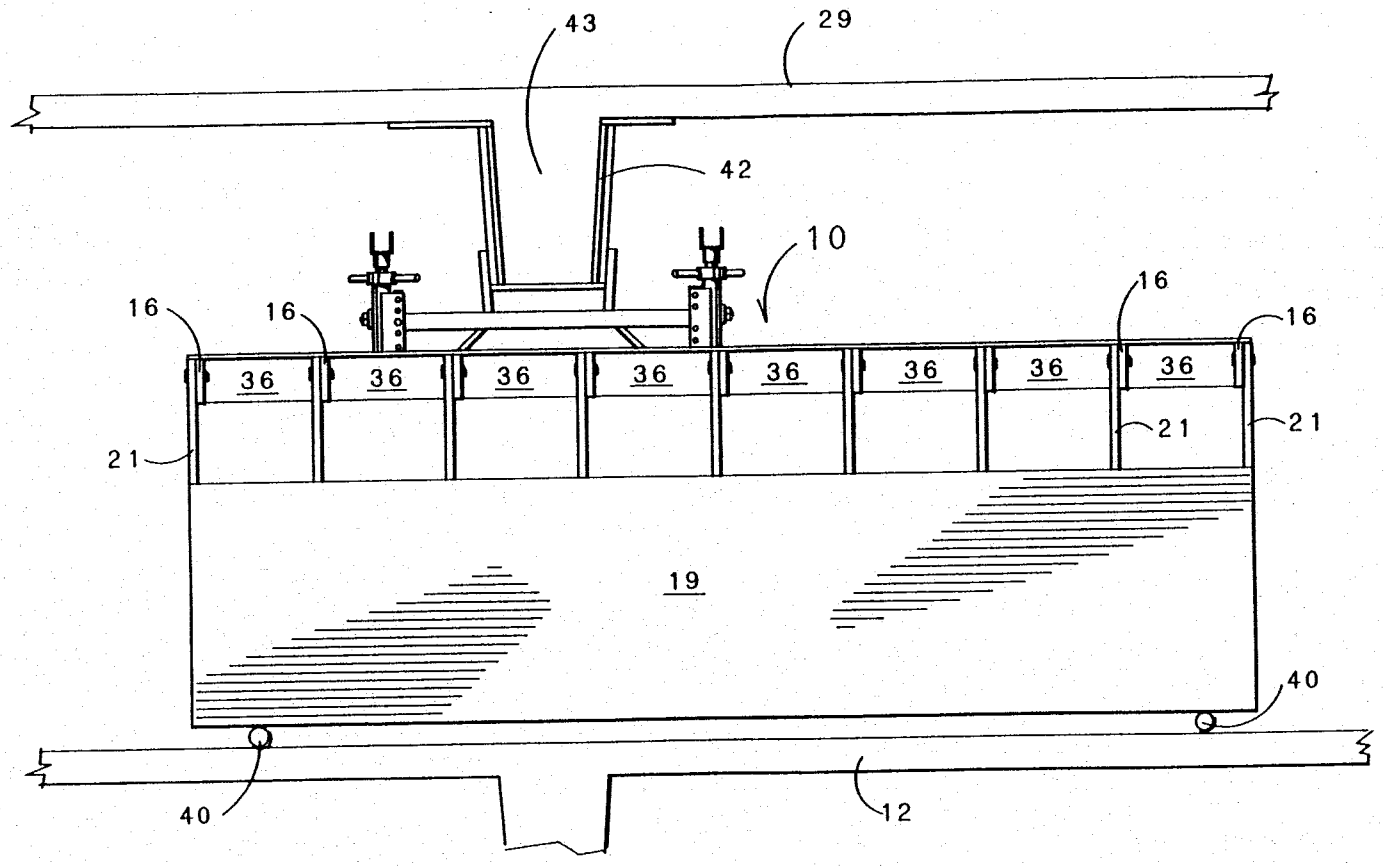
FIG. 4 is a side view of the concrete slab and beam forming system of FIG. 3.

A concrete slab form and beam forming system, labelled generally as reference numeral 10, is assembled from the components of the concrete forming system of the present invention. The concrete slab and beam forming system 10 is erected on a support surface 12 and is comprised generally of a slab form portion, labelled generally at reference numeral 17, and a shoring tower, labelled generally at reference numeral 46. Slab form 17 is comprised of first, second and third planks 16, 20 and 21, respectively. First plank 16 is provided with a first facing 14 integral therewith, second facing 18 is integral with second plank 20, and third facing 19 is integral with third plank 21. As shown in FIG. 4, there are a plurality of sets of first, second and third planks 16, 20 and 21. Second plank 20 and third plank 21 are pivotally mounted at one end thereof to first plank 16.

Figure 1:
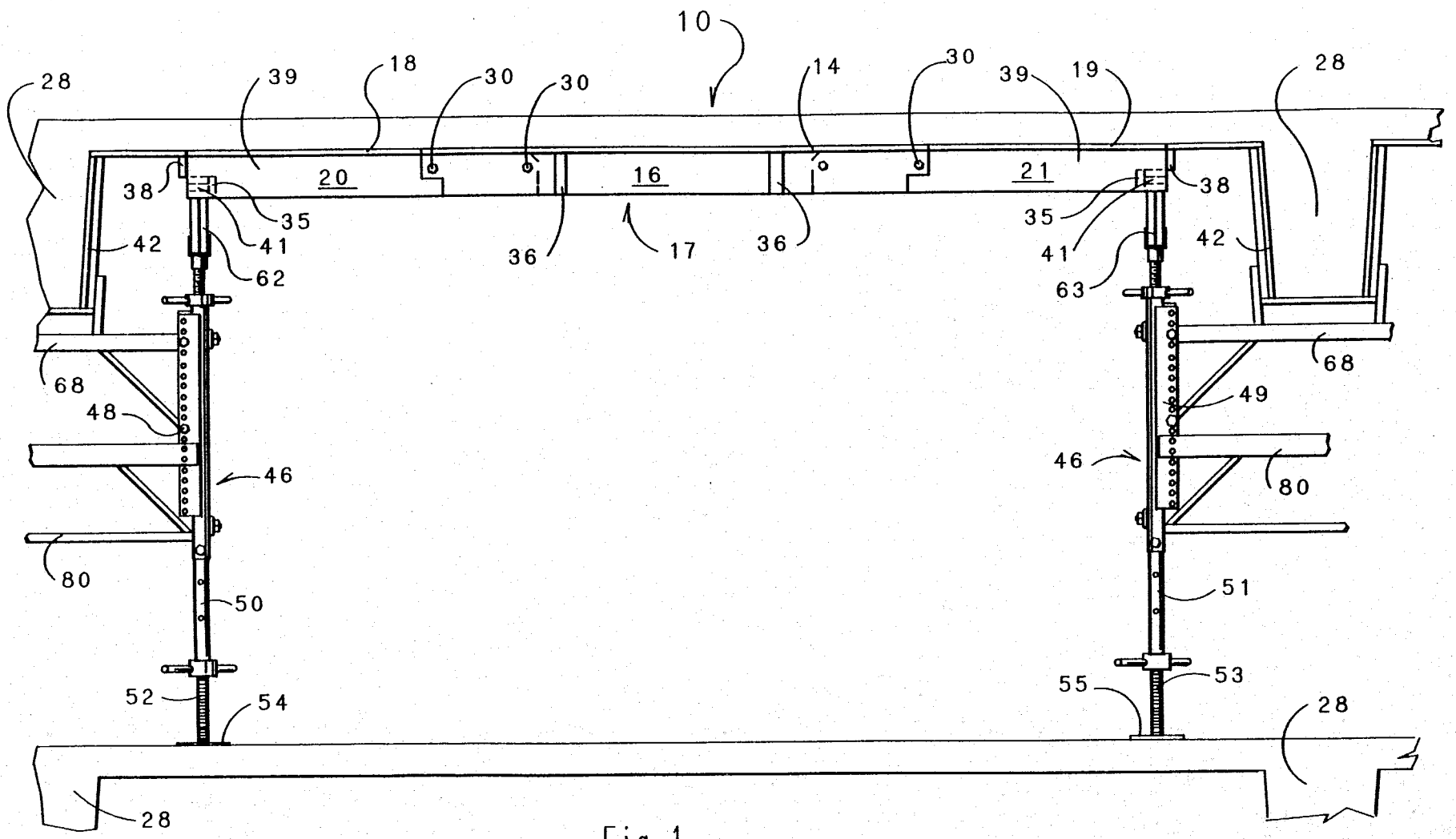
FIG. 1 is an end view of a concrete slab and beam forming system constructed according to the teachings of the present invention, in which the first and second facings are secured in a first coplanar position.

Referring to FIG. 1, the first facing 14, second facing 18 and third facing 19 define the bottom of a space 28 for receiving moldable material, such as concrete, therein as will be described. Because space 28 receives the moldable material, which will then cure to form a slab and beam, the portion of space 28 above facings 14, 18 and 19 will be referred to as slab 29 with regard to FIGS. 2, 3 and 4, and the portion of space 28 within beam forms 42 will be referred to as beams 43 in those same figures. The facings 14, 18 and 19 are, in a presently preferred embodiment, a sheet of plywood such as is known in the art. Of course, other materials may be used. Means are provided for securing the planks 16, 20 and 21 and the facings 14, 18 and 19 in a first coplanar position in the form of bolts 30 received within opposable holes 32 in plank 16 and 34 (see FIG. 2) in planks 20 and 21, respectively. Bolt saddles 90, shown in enlarged detailed in FIGS. 3A and 3B, can be mounted to plank 16 so that hole 92 of bolt saddle 90 coincides with holes 22 and 32 in plank 16 (see FIG. 3). In an alternative embodiment shown at one end of plank 16 in FIG. 3, bolt saddle 90 is a U-shaped steel plate having a width sufficient to fit over plank 16. Bolt saddle 90 aids in prolonging the usable life of slab form 17 by increasing the load bearing capacity of the hole 22, thereby lessening the wear on plank 16.

Bridging 36 is integral with planks 16 for additional support of facing 14 between planks 16. Planks 20 and 21 are provided with integral facings 38 and recessed casters 40, mounted adjacent facings 38 (see FIG. 2), on a support beam 35 at ends 37 and 39 thereof for moving slab form 17 over surface 12.

Figure 2:
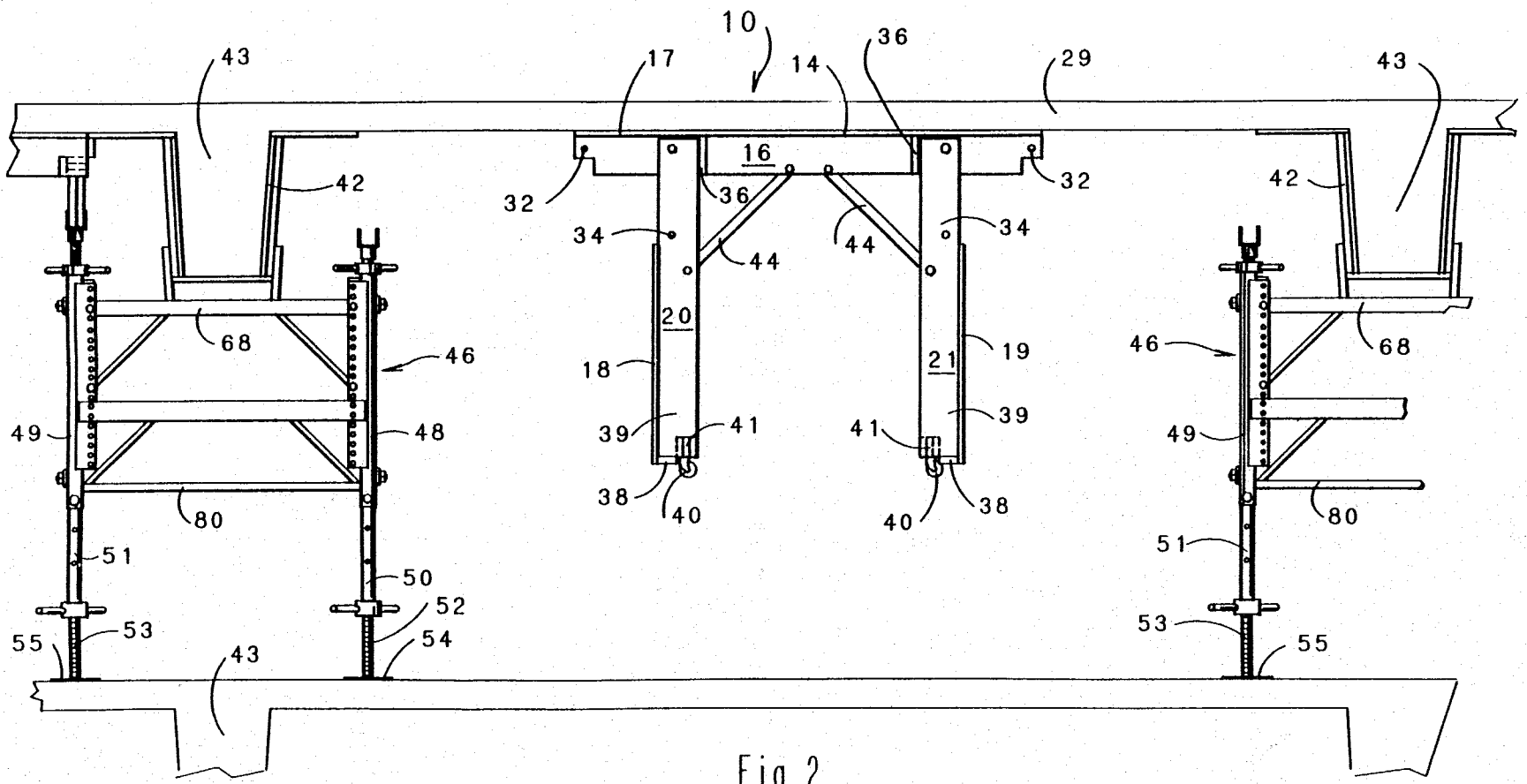
FIG. 2 is an end view of a concrete slab and beam forming system constructed according to the teachings of the present invention, in which the first and second facings are secured in a second substantially perpendicular position.
Figure 3:
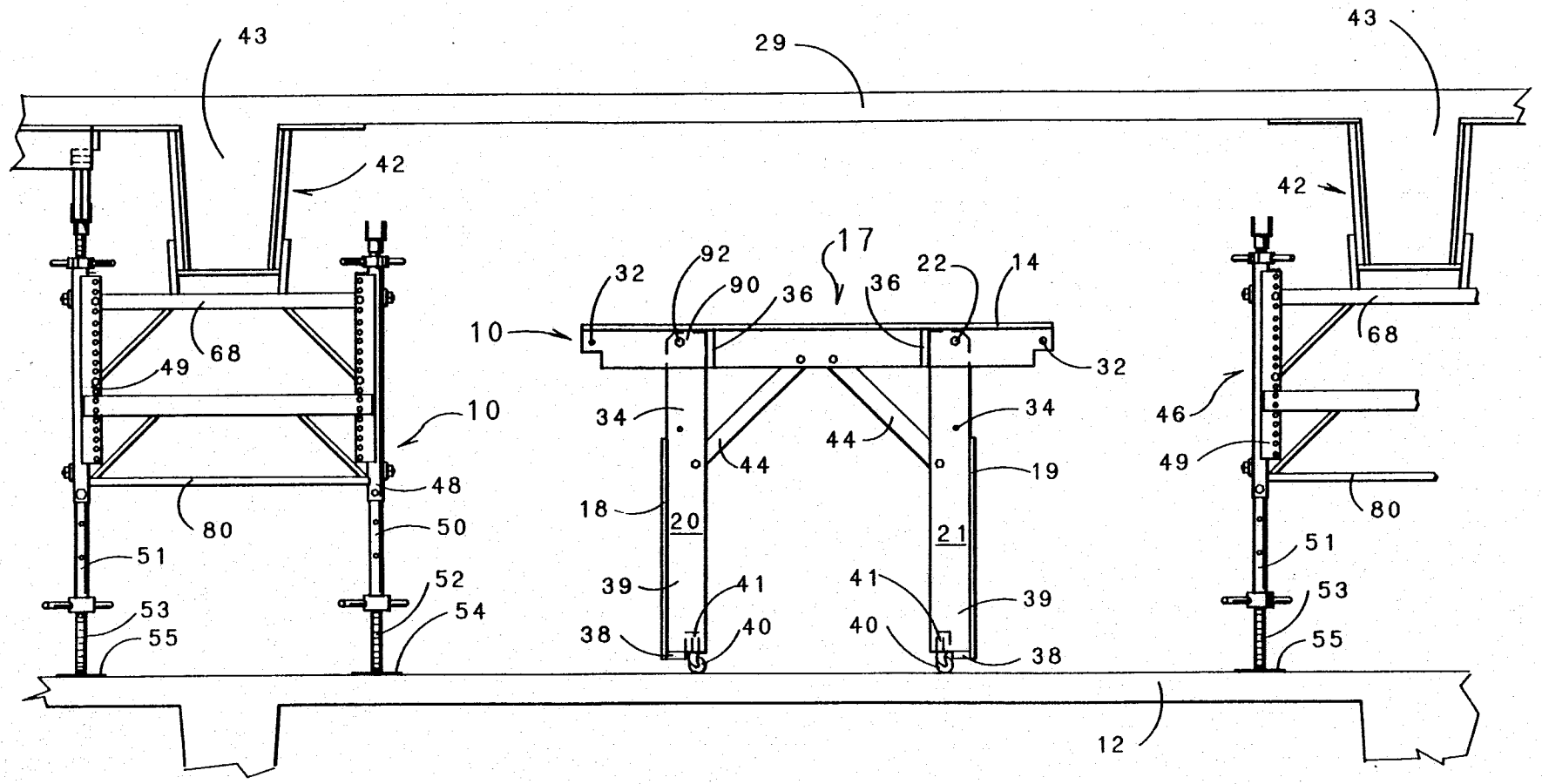
FIG. 3 is an end view of the concrete slab form and beam forming system of FIG. 2 in which the slab deckform is shown lowered away from the beam forms.
Figure 3A:
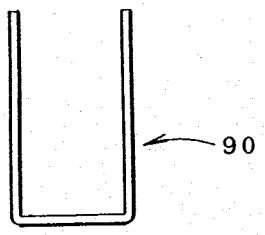
FIG. 3A is an end view of a bolt saddle which can be used to advantage in connection with the forming system of the present invention.
Figure 3B:
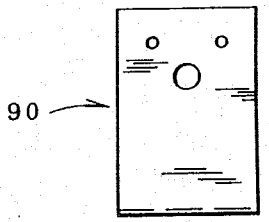
FIG. 3B is a side view of the bolt saddle of FIG. 3A.

Referring to FIGS. 2, 3 and 4, slab form 17 is shown in a second position in which second and third facings 18 and 19 are substantially perpendicular to first facing 14. Before slab 29 is poured, facing 14 is provided with a plurality of bolts (not shown), thereby securing slab form 17 to slab 29; hence, slab form 17 is shown in an intermediate position in FIG. 2 in which the ends 37 and 39 of second and third planks 20 and 21 have been pivoted away from the poured slab 29. Slab form 17 is shown in FIG. 2 in a second position in which the second and third facings 18 and 19 are in that second position substantially perpendicular to first facing 14.

Slab form 17 is then released from slab 29 by unbolting and lowering slab form 17 from slab 29 with a forklift. Means for moving slab form 17 over surface 12, in the form of casters 40 retractably received within recess 41 in second and third planks 20 and 21. Casters 40 are secured in a locked position for rolling. Referring to FIG. 3, slab form 17 is shown lowered from slab 29, and resting on casters 40. The slab form 17 is also shown in the second position in side view in FIG. 4. The height of slab form 17 when pivoted to the second position is such that the entire slab form 17 can be rolled underneath beam forms 42 and between shoring towers 46 on casters 40.

Referring to FIGS. 5, 6A, 6B, 7A and 7B, shoring tower 46 is provided with legs 48 and 49 having telescopic components 50 and 51 received within the bottom ends of legs 48 and 49. Screw jacks 52 and 53 are provided with base plates 54 and 55 at the bottom end of legs 48 and 49. Telescopic components 50 and 51 of legs 48 and 49 are provided with holes 82 and 83 and telescopic components 50 and 51 are selectively positionable within legs 48 and 49 at a chosen spaced interval by securing bolts 56 and 57 through legs 48 and 49 and holes 82 and 83 of telescopic components 50 and 51.

At a second end of legs 48, top screw jacks 58 and 59 are provided having U-shaped steel plates 60 and 61 for receiving stringers 62 and 63 thereon, for connection to and support of planks 20 and 21 at the ends 37 and 39 of adjacent slab forms 17. Guide bars 64 and 65 having a plurality of spaced holes 66 and 67 thereon and are rigidly formed on legs 48 and 49. In a presently preferred embodiment, guide bars 64 and 65 are rigidly mounted on two sides of legs 48 and 49, having holes 66 and 67 placed in opposition. A ledger 68 is received adjacent to and between guide bars 64 at one end of ledger 68 and guide bars 65 at a second end of ledger 68 and is selectively positionable in the holes 66 and 67 along the length of guide bars 64 and 65 for supporting beam form 42 at a preferred height. Ledger 68 is secured in a chosen spaced position by bolts 70 and 71 received through guide bars 64 and 65 within holes 66 and 67, and through holes (not numbered) within ledger 68.

A beam form 42 for molding a concrete beam in a presently preferred embodiment is comprised of laminated veneer lumber, as is known in the art. Beam form 42 rests on ledger 68 in a chosen spaced position above surface 12. Anchor beams 94 (see FIGS. 6A and 7A) are mounted on either side of beam form 42 to stabilize beam form 42. Anchor beams 94 are releasably secured to ledger 68 by bolts 96. Ledger 68 is supported by brackets 86. A second ledger 78 and a third ledger 80 are positioned at spaced intervals between legs 48 for support of legs 48. Bracing means in the form of brackets 84 support and further stabilize ledgers 78 and 80 and are secured at one end to ledger 78 and at a second end to ledger 80. Brackets 86 further support ledger 68, and are mounted at a first end to ledger 68, and at second ends to guide bars 64 and 65.

Figure 5:
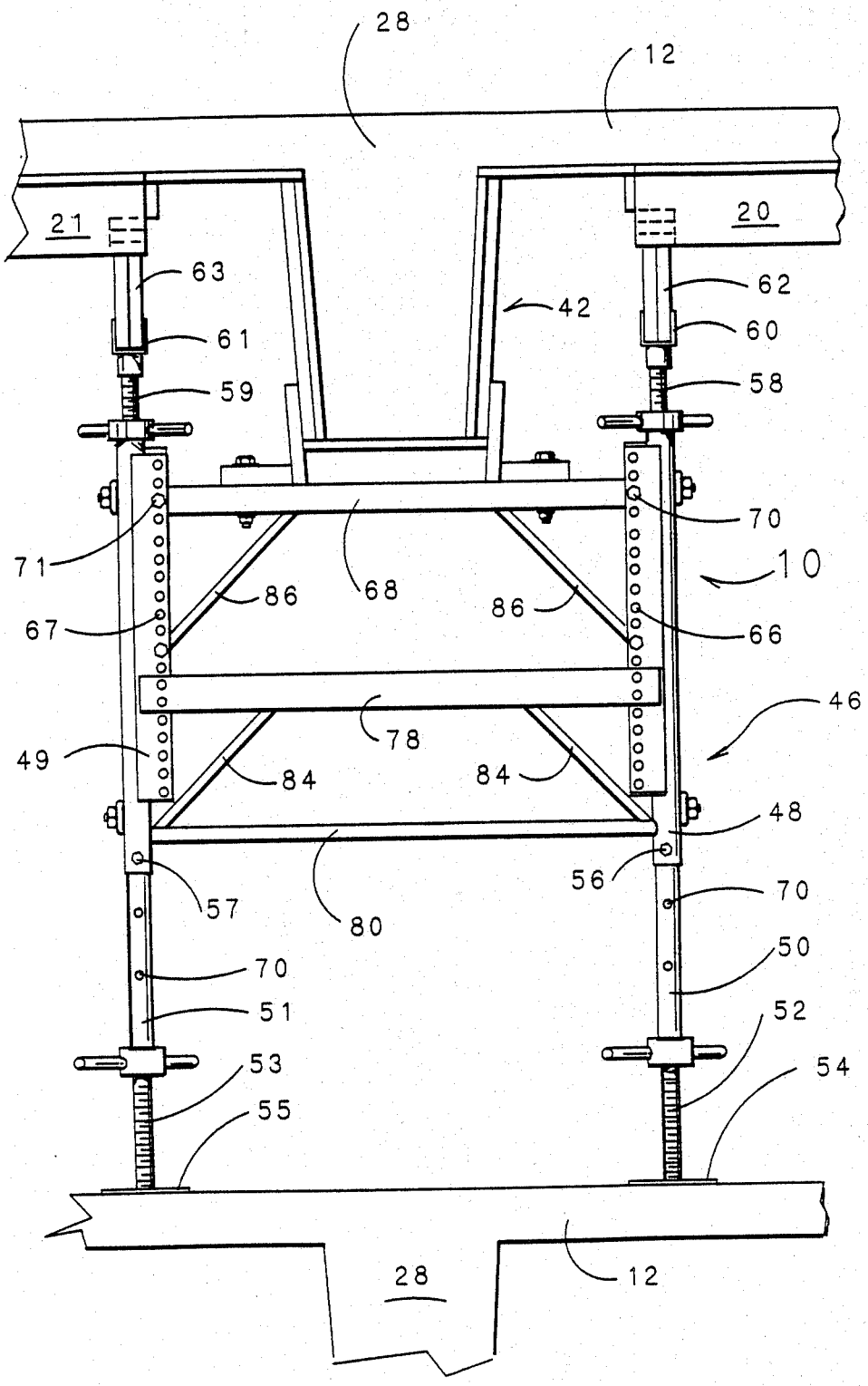
FIG. 5 is an end view of the shoring tower of FIGS. 1–4, showing the beam form cutaway to show the details of the construction of the shoring tower.
Figure 6A:
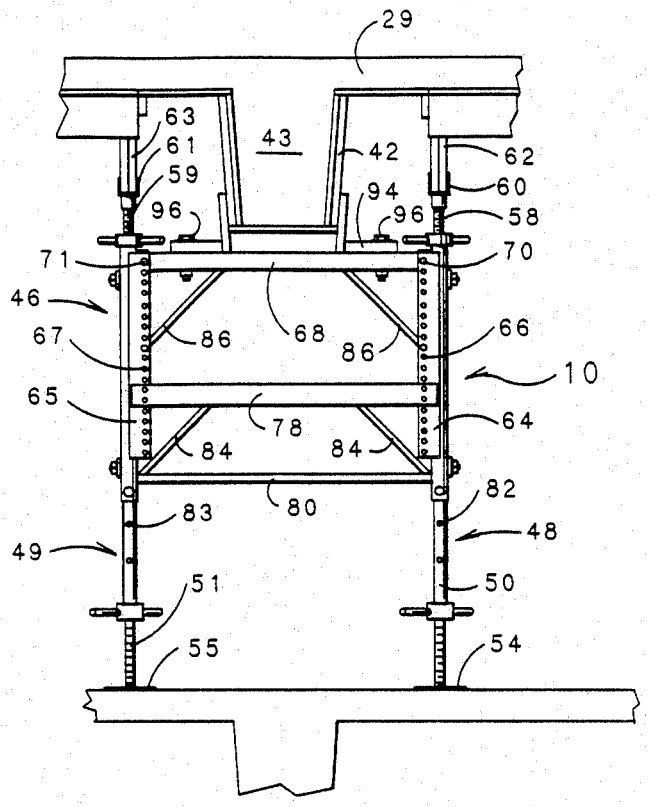
FIG. 6A is an end view of a shoring tower similar to the shoring tower of FIG. 5 after concrete has been poured in the beam form.
Figure 7A:
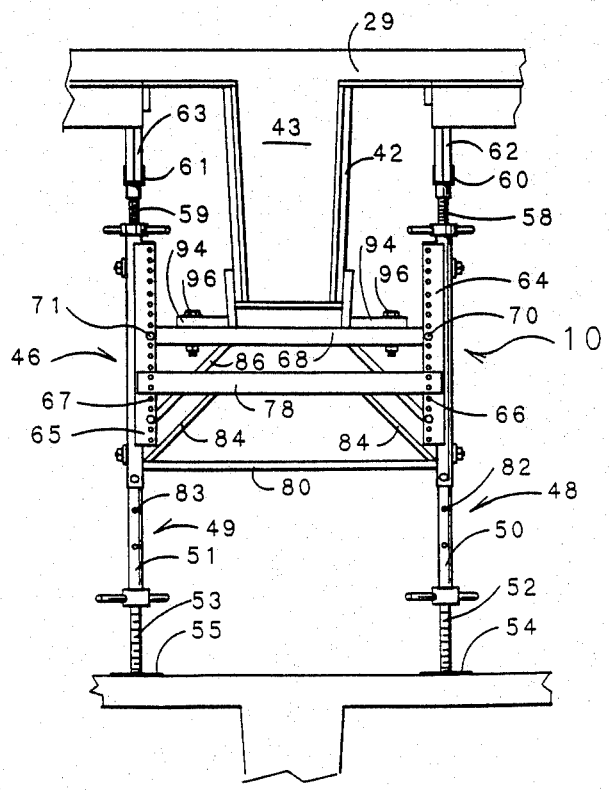
FIG. 7A is an end view of a shoring tower similar to the shoring tower of FIG. 6A, showing the ledger adjusted downwardly to support a deeper beam than that supported by the beam form of FIG. 6A.
Figure 6B:
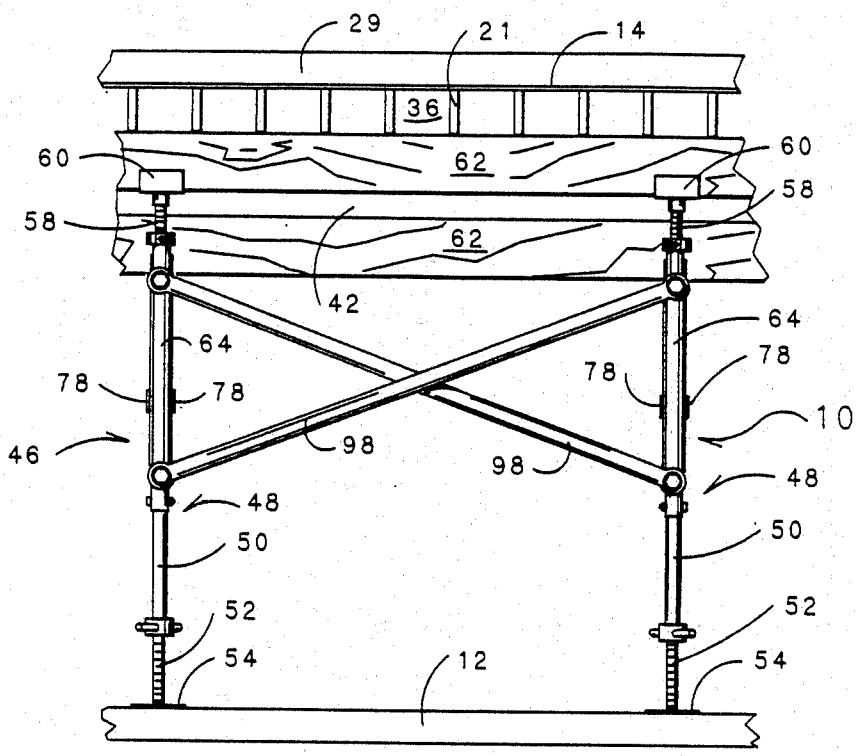
FIG. 6B is a side view of two of the shoring towers of FIG. 6A.
Figure 7B:
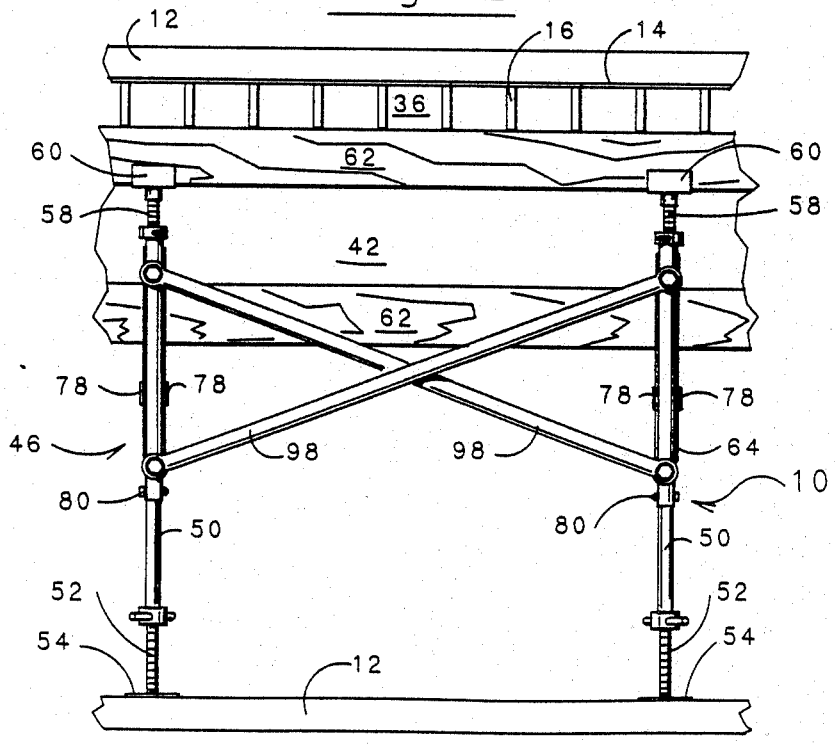
FIG. 7B is a side view of two of the shoring towers of FIG. 7B.

The shoring tower 46 can be assembled so that ledger 68 supports beam form 42 at a preferred height as is shown in Figs. 6A, 6B, 7A and 7B, and legs 48 and 49 can be adjusted for particular elevations by adjusting telescopic components 50 and 51 and bottom screw jacks 52 and 53 and top screw jacks 58 and 59. The height of shoring tower 46 can be adjusted to support planks 16, 20 and 21 of slab form 17 at a selected elevation. In actual use, a plurality of shoring towers 46 support a single beam form 42. As is shown in FIGS. 5, 6B and 7B, cross bars 98 are mounted between adjacent shoring towers 46 for support and stabilization.

After concrete has been poured over slab form 17 and has cured into a slab 29, slab form 17 can be released by removing stringers 62 and 63 from U-plates 60 and 61 so that planks 20 and 21 and facings 18 and 19 can be lowered away from shoring tower 46. After slab form 17 has been lowered away from slab 29, the slab form 17 can be easily transported and stored, or easily reused while shoring tower 46 remains in place, permitting complete curing of concrete poured into beam form 42 into a beam 43.

A method for constructing a concrete slab 29 supported by a beam 43 is provided. First and second shoring towers designated generally at numeral 46 in FIGS. 1, 2, 3, 4, 5, 6A, 6B, 7A, and 7B are erected by placing base plates 54 and 55 of bottom screw jacks 52 and 53 in a chosen spaced position on a surface 12. The ends 37 and 39 of planks 20 and 21, respectively, of slab form 17 are releasably supported on stringers 62 and 63 secured within U-plates 60 and 61. The U-plates 60 and 61 are rigidly mounted to top screw jacks 58 and 59 and hold stringers 62 and 63 between the shoring tower 46 and ends 37 and 39. Adjustment of screw jacks 52, 53, 58, and 59, lengthening of telescopic portions 50 and 51 within legs 48 and 49 of shoring tower 46, and variation in the length of stringers 62 and 63 together determine the height of shoring tower 46 and the height at which slab form 17 is supported above surface 12.

After shoring tower 46 is erected supporting slab form 17, the beam form 42 can also be positioned at a selected height above surface 12 by vertical adjustment of ledger 68, which supports beam form 42 integral therewith. Beam form 42 is stabilized by anchor beams 94 mounted on either side to ledger 68. Ledger 68 can be positioned as shown in FIG. 6A to form a beam 43 having a shallow depth or as shown in FIG. 7A to support a deeper beam form 42 and thus form a deeper beam 43. The concrete slab 29 and concrete beam 43 cure at the same rate but greater curing strength is required before support can be removed from concrete beam 43. When slab 29 is cured sufficiently, the ends 37 and 39 of planks 20 and 21 of slab form 17 can be released from first and second shoring towers 46 by first removing stringers 62 and 63 and screw jacks 58 and 59, and then pivoting planks 20 and 21 having facings 18 and 19 integral therewith away from slab 29. Slab form 17 is then released from slab 29 and lowered to surface 12. Slab form 17 is then rolled on casters 40 to another location for use, leaving shoring towers 46 in place for an additional time to permit additional curing of beams 43 molded within beam forms 42.

The presently preferred embodiment of the invention having been described, it is understood that the variations and modifications which may occur to those skilled in the art to have the benefit of the disclosure are intended to fall within the scope of the invention as set out in the following claims.

What is claimed is:

1. A concrete slab and beam forming system comprising:

first and second shoring towers for use in forming a pair of spaced beams, each of said shoring towers comprising a first leg, a second leg substantially parallel to said first leg, said first legs of said towers being positioned between said second legs of said towers, a first guide bar integral with said first leg and having a plurality of holes spaced along the length thereof, a second guide bar integral with said second leg and having a plurality of holes spaced along the length thereof, a ledger selectively positionable in the holes spaced along said first and second guide bars, and means mounted to said ledger for forming a concrete beam;

said system further comprising:

a first plank having a facing integral therewith;

a second plank having a facing integral therewith;

a third plank having a facing integral therewith;

said second and third planks being pivotally attached at one end thereof to opposite ends of said first plank and supported at the other end thereof by the first leg of said first shoring tower and the first leg of said second shoring tower, respectively, in a first position in which the facings of said first, second and third planks are substantially coplanar for forming a concrete slab between said spaced beams;

means for releasably securing said second and third planks in said first position; and means for securing said second and third planks in a second position in which the facing of said second and third planks is substantially perpendicular to the facing of said first plank.

2. The concrete slab and beam forming system of claim 1 additionally comprising means for moving said first, second and third planks between said first and second shoring towers when in said second position.

3. The concrete slab and beam forming system of claim 2 wherein said moving means comprises a caster retractably received within said second and third planks.

4. The concrete slab and beam forming system of claim 1 wherein said means for securing said first and second facings in said first position comprises bolts received within opposable holes in said first and second planks and said first and third planks.

5. The concrete slab and beam forming system of claim 1 wherein said means for securing said first and second planks in said second position comprises a brace releasably secured at a first end to said first plank and at a second end to said second plank, and said means for securing said first and third planks in said second position comprises a brace releasably secured at a first end to said first plank and at a second end to said third plank.

6. The concrete slab and beam forming system of claim 1 additionally comprising stop means on said second plank for stopping the pivotal movement of said second plank relative to said first plank and stop means on said third for stopping the pivotal movement of said third plank relative to said first plank.

7. The concrete slab and beam forming system of claim 1 wherein said ledger is provided with selectively positionable bracing means.

8. The concrete slab and beam forming system of claim 7 wherein one end of said bracing means is integral with said ledger and another end of said bracing means is releasably secured in the holes of said guide bars.

9. The concrete slab and beam forming system of claim 1 additionally comprising a lock pin received through said guide bars and said ledger for selectively positioning of said ledger.

10. The concrete slab and beam forming system of claim 1 additionally comprising a screw jack mounted on an end of each said leg.

11. A slab form comprising:

a first plank;

a second plank pivotally attached to said first plank;

a first facing integral with said first plank;

a second facing integral with said second plank;

means for releasably securing said first and second planks against movement with respect to each other in a position in which said first and second facings are positioned in a first coplanar position;

means for securing said first and second planks against movement with respect to each other in a position in which said first and second facings are positioned in a second substantially perpendicular position; and a caster retractably received within said second plank for moving said slab form over a surface.

12. The slab form of claim 11 wherein said means for securing said first and second facings in said first position comprises a bolt received within opposable holes in said first and second planks.

13. The slab form of claim 11 wherein said means for securing said first and second planks in said second position comprises a brace releasably secured at a first end to said first plank and at a second end to said second plank.

14. A slab form comprising:

first and second planks;

first and second facings, each of said first and second facings being integrally mounted to said first and second planks, respectively;

means for releasably securing said first and second planks against movement with respect to each other in a position in which said first and second facings are positioned in a first substantially coplanar position;

means for securing said first and second planks against movement with respect to each other in a position in which said first and second facings are positioned in a second substantially perpendicular position; and a caster mounted on the end of said second plank and movable between a first retracted position when said first and second facings are positioned in said first substantially coplanar position and a second position for moving said slab form over a surface when said first and second facings are positioned in said second substantially perpendicular position.

* * * * *